United States Patent [19]

Rose et al.

[11] Patent Number: 4,880,565

[45] Date of Patent: Nov. 14, 1989

[54] FLUORINE CONTAINING VISCOELASTIC SURFACTANTS

[75] Inventors: Gene D. Rose; Arthur S. Teot, both of Midland, Mich.; Keith G. Seymour, Maryville, Mo.

[73] Assignee: The Dow Chemical Company, Midland, Mich.

[21] Appl. No.: 722,484

[22] Filed: Apr. 12, 1985

Related U.S. Application Data

[62] Division of Ser. No. 528,314, Aug. 31, 1983, Pat. No. 4,770,814.

[51] Int. Cl.[4] ..... B01F 17/18; B01F 17/26; B01J 13/00

[52] U.S. Cl. ..... 252/355; 71/DIG. 1; 44/51; 106/20; 137/13; 252/8; 252/8.05; 252/49.5; 252/312; 252/356; 252/357; 422/43; 526/932

[58] Field of Search ..... 252/315.4, 356, 357, 252/355; 137/13; 422/43

[56] References Cited

U.S. PATENT DOCUMENTS

| | | | |
|---|---|---|---|
| 2,541,816 | 2/1951 | Glarum et al. | 544/108 X |
| 3,361,213 | 1/1968 | Savins | 137/13 X |
| 3,373,107 | 3/1968 | Rice et al. | 252/8.55 R |
| 3,494,949 | 2/1970 | Monroe et al. | 556/174 |
| 3,505,374 | 4/1970 | Monroe | 556/26 |
| 3,575,859 | 4/1971 | Monroe | 252/32.5 |
| 4,089,804 | 5/1978 | Falk | 252/357 X |

FOREIGN PATENT DOCUMENTS

| | | |
|---|---|---|
| 1259113 | 1/1972 | United Kingdom . |
| 1285197 | 8/1972 | United Kingdom . |

OTHER PUBLICATIONS

Schwartz et al.: *Surface Active Agents and Detergents,* Vol. II, Interscience Publishers, Inc., New York, pp. 729–730 (1958).

Gravsholt: "Viscoelasticity in Highly Dilute Aqueous Solutions of Pure Cationic Detergents", J. of Coll. and Interface Sci., 57 (3) pp. 575–576 (1976).

Hoffman et al.: "The Influence of Counter-Ion Concentration on the Aggregation Behaviour of Viscoelastic Detergents", Ber. Bunsenges. Phys. Chem., 85, pp. 877–882 (1981).

W. Janna et al.: "Drop-Size Distributions of Newtonian Liquid Sprays . . . ", Journal of Engineering for Industry, 101, pp. 171–177 (1979).

Hoffmann et al.: "Investigations on Micellar Systems of Perfluordetergents . . . ", *Z. Phy. Chem.* 113, pp. 17–36 (Wiesbaden, 1978).

*Primary Examiner*—Richard D. Lovering

[57] ABSTRACT

Shear stable antimisting properties are provided to a wide variety of formulations comprising aqueous liquids through the use of a viscoelastic surfactant which comprises a surfactant compound having a hydrophobic moiety chemically bonded to an ionic, hydrophilic moiety and an electrolyte having a moiety that is capable of associating with the surfactant ion. Optionally, an additional amount of electrolyte can be added to the viscoelastic surfactant to further reduce misting. The viscoelastic surfactant can also be a nonionic surfactant.

8 Claims, No Drawings

FLUORINE CONTAINING VISCOELASTIC SURFACTANTS

CROSS-REFERENCE TO RELATED APPLICATIONS

This application is a division of application Ser. No. 528,314, filed Aug. 31, 1983, and entitled "Shear Stable Antimisting Formulations", now U.S. Pat. No. 4,770,814.

BACKGROUND OF THE INVENTION

The present invention relates to a method for providing antimisting properties to an aqueous liquid and to the aqueous liquid systems having such antimisting properties.

The use of aqueous liquids in industrial applications often subjects said liquids to agitation and impact which results in mist formation. In addition, numerous industrial applications require the production of a spray of controlled droplet size. A reduction in the amount of mist generated in the use of such liquids permits a more efficient use of said liquids, reduces health hazards and reduces fire hazards.

Heretobefore, various alternatives have been proposed in an attempt to reduce the amount of misting exhibited by aqueous fluids when used in industrial processes. For example, ultra-high molecular weight polymers are added to aqueous formulations. Unfortunately, such aqueous liquid systems are not shear stable and thus irreversibly lose their utility due to the fact that said high molecular weight polymers undergo mechanical degradation of their molecular weight. In addition, ultra-high molecular weight polymers are difficult to dissolve in aqueous liquids, and typically result in a formulation exhibiting a high viscosity even at a very low polymer concentration.

In view of the aforementioned deficiencies of the prior art, it is highly desirable to reduce the amount of misting exhibited by aqueous liquids which are used in industrial applications.

SUMMARY OF THE INVENTION

Accordingly, in one aspect, the present invention is a method for imparting shear stable antimisting properties to aqueous liquids through the use of a viscoelastic surfactant. This method comprises adding to said aqueous liquid a functionally effective amount of (1) a surfactant compound having a hydrophobic moiety chemically bonded to an ionic, hydrophilic moiety (hereinafter a surfactant ion) and (2) an electrolyte having a moiety that is capable of associating with the surfactant ion to form a viscoelastic surfactant. For the purposes of this aspect of the invention, a viscoelastic surfactant is a compound having (1) an ion capable of acting as a surfactant and (2) a stoichiometric amount of a counterion that associates with the surfactant ion to render it viscoelastic as defined hereinafter. The resulting viscoelastic surfactant is employed in an amount sufficient to reduce the misting of the aqueous liquid as it is employed in various applications. An electrolyte, which can associate as the counterion with the surfactant ion to form a viscoelastic surfactant, can be employed in an additional amount sufficient to further reduce the misting exhibited by the aqueous liquid containing the viscoelastic surfactant when it is employed in industrial applications. The electrolyte can be the same as or different from that counterion associated with the surfactant ion.

Surprisingly, the presence of the additional electrolyte in an aqueous liquid containing the viscoelastic surfactant in accordance with the practice of this invention significantly further reduces the misting exhibited by the aqueous fluid containing the viscoelastic surfactant as the liquid is employed in industrial applications. The admixture of the aqueous liquid, electrolyte and viscoelastic surfactant is significantly more shear stable than an aqueous liquid containing a polymer capable of providing the aqueous liquid with the same degree of mist reduction.

In another aspect, the present invention is a method for imparting shear stable antimisting properties to aqueous liquids through the use of a nonionic viscoelastic surfactant. This method comprises adding to said aqueous liquid a functionally effective amount of a surfactant compound having a hydrophobic moiety chemically bonded to a nonionic, hydrophilic moiety (hereinafter a nonionic surfactant), which compound is capable of exhibiting a viscoelastic character. The nonionic viscoelastic surfactant is employed in an amount sufficient to reduce the misting of the aqueous liquid as it is employed in various applications.

The method of this invention is useful in those processes where water or other aqueous liquid is subjected to agitation, impact, or said liquid is employed in the form of a controlled spray.

DETAILED DESCRIPTION OF THE PREFERRED EMBODIMENTS

As used herein, the term "aqueous liquid" refers to those liquids which contain water. Included within the term are aqueous liquids containing inorganic electrolytes, such as aqueous solutions of inorganic salts, aqueous alkaline or aqueous acidic solutions, depending upon the particular surfactant and electrolyte employed, e.g., an aqueous solution of an alkali metal or alkaline earth metal hydroxide. Other exemplary aqueous liquids include mixtures of water and a water-miscible liquid such as lower alkanols, e.g., methanol, ethanol or propanol; glycols and polyglycols and the like, provided that such water-miscible liquids are employed in amounts that do not deleteriously affect the viscoelastic properties of the aqueous liquid. Also included are emulsions of immiscible liquids in the aqueous liquid, aqueous slurries of solid particulates such as herbicides and other toxicants, coal particles and finely divided mineral ores. In general, however, water and aqueous alkaline, aqueous acidic or aqueous inorganic salt solutions (i.e., brine solutions) are most beneficially employed as the aqueous liquid herein. Advantageously, the electrolyte concentration is less than about 75, preferably less than about 15, more preferably less than 5, especially less than 1, percent by weight of the solution. Most preferably, the aqueous liquid is water.

The term "mist" as it applies to aqueous liquids, means fine liquid droplets suspended in or falling through a moving or stationary gas atmosphere. Specifically, a mist provides an undesirable drift of aqueous droplets through a gas atmosphere. The properties of a mist are well known in the art and reference is made to Perry and Chilton, *Chemical Engineer's Handbook*, 5th Ed., Vol. 18, McGraw-Hill (1973), which is hereby incorporated by reference for a definition of mist and tests to determine properties of such exemplary mists. In distinguishing a mist from a spray, a mist is generally defined as a gas suspended liquid particle which has a diameter of less than about 10 μm, while a spray is a gas suspended liquid particle which has a diameter of greater than about 10 μm. However, it is understood that the specific size of spray and mist particles may vary depending upon the industrial use such as where a controlled droplet size is desired. As used herein, the term "antimisting" as it applies to an aqueous liquid refers to the property which comprises the tendency of said liquid to not form a mist or undersized droplet.

The term "viscoelastic" as it applies to liquids, means a viscous liquid having elastic properties, i.e., the liquid at least partially returns to its original form when an applied stress is released. The property of viscoelasticity is well-known in the art and reference is made to H. A. Barnes et al., *Rheol. Acta,* 1975 14, pp. 53–60 and S. Gravsholt, *Journal of Coll. and Interface Sci.,* 57 (3) pp. 575–6 (1976), which are hereby incorporated by reference for a definition of viscoelasticity and tests to determine whether a liquid possesses viscoelastic properties. Of the test methods specified by these references, one test which has been found to be most useful in determining the viscoelasticity of an aqueous solution consists of swirling the solution and visually observing whether the bubbles created by the swirling recoil after the swirling is stopped. Any recoil of the bubbles indicates viscoelasticity.

In general, ionic surfactant compounds comprise an ionic hydrophobic molecule having an ionic, hydrophilic moiety chemically bonded to a hydrophobic moiety (herein called a surfactant ion) and a counterion sufficient to satisfy the charge of the surfactant ion. Examples of such surfactant compounds are represented by the formula:

$$R_1(Y^{63})X^{\oplus} \text{ or } R_1(Z^{\oplus})A^{\ominus}$$

wherein $R_1(Y^{\ominus})$ and $R_1(Z^{\oplus})$ represent surfactant ions having a hydrophobic moiety represented by $R_1$ and an ionic, solubilizing moiety represented by the cationic moiety ($Y^{\ominus}$) or the anionic moiety ($Z^{\oplus}$) chemically bonded thereto. $X^{\oplus}$ and $A^{\ominus}$ are the counterions associated with the surfactant ions.

Surfactant compounds within the scope of this invention include compounds broadly classified as surfactants which, through the proper choice of counterion structure and environment, give viscoelasticity. The term "surfactant" is taken to mean any molecule having a characteristic amphiphatic structure such that it has the property of forming colloidal clusters, commonly called micelles, in solution.

In general, the hydrophobic moiety (i.e., $R_1$) of the surfactant ion is hydrocarbyl or inertly substituted hydrocarbyl wherein the term "inertly substituted" refers to hydrocarbyl radicals having one or more substituent groups, e.g., halo groups such as —F, —Cl or —Br or chain linkages, such as a silicon linkage (—Si—), which are inert to the aqueous liquid and components contained therein. Typically, the hydrocarbyl radical is an aralkyl group or a long chain alkyl or inertly substituted alkyl, which alkyl groups are generally linear and have at least about 12, advantageously at least about 16, carbon atoms. Representative long chain alkyl and alkenyl groups include dodecyl (lauryl), tetradecyl (myristyl), hexadecyl (cetyl), octadecenyl (oleyl), octadecyl (stearyl) and the derivatives of tallow, coco and soya. Preferred alkyl and alkenyl groups are generally alkyl and alkenyl groups having from about 14 to about 24 carbon atoms, with octadecyl, hexadecyl, erucyl and tetradecyl being the most preferred.

The cationic, hydrophilic moieties (groups), i.e., ($Y^{\oplus}$), are generally onium ions wherein the term "onium ions" refers to a cationic group which is essentially completely ionized in water over a wide range of pH, e.g., pH values from about 2 to about 12. Representative onium ions include quaternary ammonium groups, i.e., $—N^{\oplus}(R)_3$; tertiary sulfonium groups, i.e., $—S^{\oplus}(R)_2$; quaternary phosphonium groups, i.e., $—P^{\oplus}(R)_3$ and the like, wherein each R is individually a hydrocarbyl or inertly substituted hydrocarbyl. In addition, primary, secondary and tertiary amines, i.e., $—NH_2$, —NHR or $—N(R)_2$, can also be employed as the ionic moiety if the pH of the aqueous liquid being used is such that the amine moieties will exist in ionic form. A pyridinium moiety can also be employed. Of such cationic groups the surfactant ion of the viscoelastic surfactant is preferably prepared having quaternary ammonium, i.e., $—N^{\oplus}(R)_3$; a pyridinium moiety; or tertiary amine, $—N(R)_2$, groups wherein each R is independently an alkyl group or hydroxyalkyl group having from 1 to about 4 carbon atoms, with each R preferably being methyl, ethyl or hydroxyethyl.

Representative anionic, solubilizing moieties (groups) ($Z^{\ominus}$) include sulfate groups, i.e., $—OSO_3$, ether sulfate groups, sulfonate groups, i.e., $—SO_3$, carboxylate groups, phosphate groups, phosphonate groups, and phosphonite groups. Of such anionic groups, the surfactant ion of the viscoelastic surfactants is preferably prepared having a carboxylate or sulfate group. For purposes of this invention, such anionic solubilizing moieties are less preferred than cationic moieties.

Fluoroaliphatic species suitably employed in the practice of this invention include organic compounds represented by the formula:

$$R_fZ^1$$

wherein $R_f$ is a saturated or unsaturated fluoroaliphatic moiety, preferably containing a $F_3C$— moiety and $Z^1$ is an ionic moiety or potentially ionic moiety. The fluoroaliphatics can be perfluorocarbons. Suitable anionic and cationic moieties will be described hereinafter. The fluoroaliphatic moiety advantageously contains from about 3 to about 20 carbons wherein all can be fully fluorinated, preferably from about 3 to about 10 of such carbons. This fluoroaliphatic moiety can be linear, branched or cyclic, preferably linear, and can contain an occasional carbon-bonded hydrogen or halogen other than fluorine, and can contain an oxygen atom or a trivalent nitrogen atom bonded only to carbon atoms in the skeletal chain. More preferable are those linear perfluoroaliphatic moieties represented by the formula: $C_nF_{2n+1}$ wherein n is in the range of about 5 to about 10. Most preferred are those linear perfluoroaliphatic moieties represented in the paragraphs below The fluoroaliphatic species can be a cationic perfluorocarbon and is preferably selected from a member of the group consisting of $CF_3(CF_2)_rSO_2NH(CH_2)_sN^{\oplus}R''_3X^{\ominus}$; $R_FCH_2CH_2SCH_2CH_2N^{\oplus}R''_3X^{\ominus}$ and $CF_3(CF_2)_rCONH(CH_2)_sN^{\oplus}R''_3X^{\ominus}$; wherein $X^{\ominus}$ is a counterion described hereinafter, R'' is lower alkyl containing between 1 and about 4 carbon atoms, r is about 2 to about 15, preferably about 2 to about 6, and s is about 2 to about 5. Examples of other preferred cationic perfluorocarbons, as well as methods of preparation, are those listed in U.S. Pat. No. 3,775,126.

The fluoroaliphatic species can be an anionic perfluorocarbon and is preferably selected from a member of the group consisting of $CF_3(CF_2)_pSO_2O^{\ominus}A^{\oplus}$, $CF_3(CF_2)_pCOO^{\ominus}A^{\oplus}$, $CF_3(CF_2)_pSO_2NH(CH_2)_qSO_2O^{\ominus}A^{\oplus}$ and $CF_3(CF_2)_pSO_2NH(CH_2)_qCOO^{\ominus}A^{\oplus}$; wherein p is from about 2 to about 15, preferably about 2 to about 6, q is from about 2 to about 4, and $A^{\oplus}$ is a counterion described hereinafter. Examples of other preferred anionic perfluorocarbons, as well as methods of preparation, are illustrated in U.S. Pat. No. 3,172,910.

The counterions (i.e., $X^{\ominus}$ or $A^{\oplus}$) associated with the surfactant ions are most suitably ionically charged, organic materials having ionic character opposite that of the surfactant ion, which combination of counterion and surfactant ion imparts viscoelastic properties to an aqueous liquid. The organic material having an anionic character serves as the counterion for a surfactant ion having a cationic, hydrophilic moiety, and the organic material having a cationic character serves as the counterion for the surfactant ion having an anionic, hydrophilic moiety. In general, the preferred counterions exhibiting an anionic character contain a carboxylate, sulfonate or phenoxide group wherein a "phenoxide group" is $ArO^{\ominus}$ and Ar represents an aromatic ring or inertly substituted aromatic ring. Representative of such anionic counterions which, when employed with a cationic surfactant ion, are capable of imparting viscoelastic properties to an aqueous liquid include various aromatic carboxylates such as o-hydroxybenzoate; m- or p-chlorobenzoate, methylene bis-salicylate and 3,4-, 3,5- or 2,4-dichlorobenzoate; aromatic sulfonates such as p-toluene sulfonate and naphthalene sulfonate; phenoxides, particularly substituted phenoxides; and the like, where such counterions are soluble; or 4-amino-3,5,6-trichloropicolinate. Alternatively, the cationic counterions can contain an onium ion, most preferably a quaternary ammonium group. Representative cationic counterions containing a quaternary ammonium group include benzyl trimethyl ammonium or alkyl trimethyl ammonium wherein the alkyl group is advantageously octyl, decyl, dodecyl, erucyl, and the like; and amines such as cyclohexyl amine. It is highly desirable to avoid stoichiometric amounts of surfactant and counterion when the alkyl group of the counterion is large. The use of a cation as the counterion is generally less preferred than the use of an anion as the counterion. Inorganic counterions, whether anionic or cationic, can also be employed.

The particular surfactant ion and the counterion associated therewith are selected such that the combination imparts viscoelastic properties to an aqueous liquid. Of the aforementioned surfactant ions and counterions, those combinations which form such viscoelastic surfactants will vary and are easily determined by the test methods hereinbefore described. Of the surfactants which impart viscoelastic properties to an aqueous liquid, the preferred surfactant compounds include those represented by the formula:

$$CH_3\text{-}(CH_2)_n\text{-}\overset{\overset{R}{|}}{\underset{\underset{R}{|}}{N}}{}^{\oplus}\text{-}R\ X^{\ominus}$$

wherein n is an integer from about 13 to about 23, preferably an integer from about 15 to about 21; each R is independently hydrogen or an alkyl group, or alkylaryl, or a hydroxyalkyl group having from 1 to about 4 carbon atoms, preferably each R is independently methyl, hydroxyethyl, ethyl or benzyl, and $X^{\ominus}$ is o-hydroxy benzoate, m- or p-halobenzoate or an alkylphenate wherein the alkyl group is advantageously from 1 to about 4 carbon atoms. In addition, each R can form a pyridinium moiety. Especially preferred surfactant ions include cetyltrimethylammonium, oleyltrimethylammonium, erucyltrimethylammonium and cetylpyridinium.

Other preferred surfactant compounds include those represented by the formula:

$$CF_3\text{-}(CF_2)_n\text{-}SO_2NH\text{-}(CH_2)_m\text{-}\overset{\overset{R}{|}}{\underset{\underset{R}{|}}{N}}{}^{\oplus}\text{-}R\ X^{\ominus}$$

wherein n is an integer from about 5 to about 15, preferably from about 3 to about 8; m is an integer from about 2 to about 10, preferably from about 2 to about 5; R is as previously defined, most preferably methyl; and $X^{\ominus}$ is as previously defined.

The viscoelastic surfactants are easily prepared by admixing the basic form of the desired cationic surfactant ion (or acidic form of the desired anionic surfactant ion) with a stoichiometric amount of the acidic form of the desired cationic counterion (or basic form of the desired anionic counterion). Alternatively, stoichiometric amounts of the salts of the cationic surfactant ion and the anionic counterion (or equimolar amounts of the anionic surfactant ion and cationic counterion) can be admixed to form the viscoelastic surfactant. See, for example, the procedures described in U.S. Pat. No. 2,541,816.

In general, surfactant compounds having a hydrophobic moiety chemically bonded to a nonionic, hydrophilic moiety are those nonionic surfactants which exhibit a viscoelastic character, and are typically described in U.S. Pat. No. 3,373,107; and those alkylphenyl ethoxylates as are described by Shinoda in *Solvent Properties of Surfactant Solutions,* Marcel Dekker, Inc. (1967), which are incorporated herein by reference. Preferred nonionic surfactants are those tertiary amine oxide surfactants which exhibit viscoelastic character. In general, the hydrophobic moiety can be represented as the previously described $R_1$. It is understood that the nonionic surfactant can be employed in the process of this invention in combination with an additional amount of an electrolyte as described hereinafter. It is also desirable to employ an additive such as an alkanol in the aqueous liquid to which the nonionic surfactant is added in order to render the surfactant viscoelastic.

Other viscoelastic surfactants which can be employed in the process of this invention are described by D. Saul et al., *J. Chem. Soc,* Faraday Trans., 1 (1974) 70(1), pp. 163–170.

The viscoelastic surfactant (whether ionic or nonionic in character) is employed in an amount sufficient to impart viscoelastic properties to the aqueous liquid, wherein the viscoelasticity of the aqueous liquid is measured by the techniques described herein. In general, such amount of viscoelastic surfactant is sufficient to measurably reduce the misting exhibited by the aqueous liquid as it is employed in industrial applications. The specific viscoelastic surfactant employed and the concentration thereof in the aqueous liquid are dependent on a variety of factors including solution composition, temperature, and shear rate to which the flowing liquid will be subjected. In general, the concentration of any specific viscoelastic surfactant most advantageously employed herein is easily determined by experimentation. In general, the viscoelastic surfactants are preferably employed in amounts ranging from about 0.01 to about 10 weight percent based on the weight of the surfactant and aqueous liquid. The viscoelastic surfactant is more preferably employed in amounts from about 0.05 to about 1 percent based on the weight of the aqueous liquid and the viscoelastic surfactant.

In one highly preferred aspect of the practice of this invention, an electrolyte having an ionic character opposite to that of the surfactant ion and capable of being associated as an organic counterion with said surfactant ion is employed in an additional amount to further reduce the misting exhibited by the aqueous liquid containing the viscoelastic surfactant. Such electrolytes most suitably employed herein include those containing organic ions which, when associated with the surfactant ions of the surfactant compound, form a viscoelastic surfactant. The organic electrolyte, when present in an excess of that which stoichiometrically associates with the surfactant ion, is capable of further reducing misting of the aqueous liquid. Such organic electrolyte is soluble in the aqueous liquid containing the viscoelastic surfactant.

In the practice of this invention, sufficient amounts of organic electrolyte are employed to further reduce the misting exhibited by the aqueous liquid containing the viscoelastic surfactant. The misting of the aqueous liquid is that measured using test methods as set forth herein. By "further reduce the misting" is meant that, by the test methods described herein, the misting of an aqueous liquid containing the viscoelastic surfactant and organic electrolyte (i.e., the aqueous liquid containing a number of suitable organic ions in excess of that number required to fully balance the charge of the surfactant ion) is less than the misting exhibited by an aqueous liquid having an identical concentration of the viscoelastic surfactant, but containing no additional organic electrolyte.

The concentration of the organic electrolyte required in the aqueous liquid to impart the further reduction in misting is dependent on a variety of factors including the particular aqueous liquid, viscoelastic surfactant and organic electrolyte employed, and the achieved reduction in misting. In general, the concentration of the organic electrolyte will advantageously range from about 0.1 to about 20, preferably from about 0.5 to about 5, moles per mole of the viscoelastic surfactant.

In general, the organic ions are formed by the dissociation of corresponding organic electrolytes, including salts and acids or bases of a suitable organic ion. For example, an organic electrolyte which, upon dissociation, forms an anion will further reduce the misting of an aqueous liquid containing a viscoelastic surfactant having a cationic surfactant ion. Examples of such anionic organic electrolytes include the alkali metal salts of various aromatic carboxylates such as the alkali metal aromatic carboxylates, e.g., sodium salicylate and potassium salicylate and disodium methylene-bis(salicylate); alkali metal ar-halobenzoates, e.g., sodium p-chlorobenzoate, potassium m-chlorobenzoate, sodium 2,4-dichlorobenzoate and potassium 3,5-dichlorobenzoate; aromatic sulfonic acids such as p-toluene sulfonic acid and the alkali metal salts thereof; napthalene sulfonic acid; substituted phenols, e.g., ar,ar-dichlorophenols, 2,4,5-trichlorphenol, t-butylphenol, t-butylhydroxyphenol, ethylphenol, and the like.

A cationic organic electrolyte which, upon dissociation, forms a cation is also useful in further reducing the misting of an aqueous liquid containing a viscoelastic surfactant having an anionic surfactant ion. While cationic organic electrolytes are less preferred than the aforementioned anionic organic electrolytes, examples of suitable cationic electrolytes include the quaternary ammonium salts such as alkyl trimethylammonium halides and alkyl triethylammonium halides wherein the alkyl group advantageously contains 4 to 10 carbons and the halide advantageously is chloride; aryl and aralkyl trimethyl ammonium halides such as phenyl trimethyl and benzyl trimethyl ammonium chloride; alkyl trimethyl phosphonium halides and the like. Also desirable is cyclohexyl amine.

Preferably, the organic electrolyte is the same or generates the same ion associated with the surfactant ion of the viscoelastic surfactant contained by the aqueous liquid, e.g., alkali metal salicylate is advantageously employed as the additional organic electrolyte when the viscoelastic surfactant is originally prepared having a salicylate counterion. Therefore, the most preferred organic electrolytes are the alkali metal salts of an aromatic carboxylate, for example, sodium salicylate. Moreover, it is also understood that the electrolyte can be different from the counterion which is employed.

It is also possible to employ an insoluble active ingredient such as an oil or other organic ingredient emulsified in water at a concentration of about 0.05 to about 80 percent. Viscoelastic surfactants (whether ionic or nonionic in character) employed in such emulsions tend to lose their viscoelasticity. This is believed to be due to the fact that the oil penetrates the micelles and destroys the aggregates required for viscoelasticity. Viscoelastic surfactants containing excess organic electrolyte are capable of withstanding the addition of oil to aqueous liquids for longer periods of time than those viscoelastic surfactants without the excess organic electrolyte. However, fluorinated viscoelastic surfactants are able to withstand the addition of oil to the aqueous liquid in amounts up to about 80 weight percent, most preferably up to about 20 weight percent for a longer period of time.

The aqueous liquids which exhibit reduced misting when used in industrial applications are prepared surfactant and organic electrolyte to form an aqueous liquid solution. Alternatively, the nonionic surfactant is contacted with the aqueous liquid to form an aqueous liquid solution. The resulting solutions are stable and can be stored for long periods of time. The aqueous liquids also comprise additives in order that said liquids can be employed for numerous industrial purposes. Examples of industrial uses include fire fighting systems, industrial processing, grinding and cutting fluids, agricultural sprays, water-based paint sprays, aqueous printing inks, and the like.

The following examples are presented to illustrate the invention and should not be construed to limit its scope. All percentages and parts are by weight unless otherwise noted.

EXAMPLE 1

The degree of misting of various viscoelastic formulations is determined by placing a small volume (viz.

about 0.05 to about. 0.1 ml) of aqueous liquid sample comprising deionized water, a small amount of methylene blue dye, a viscoelastic surfactant and, optionally, other additives into a small holder fastened to a spring catapult. The sample is propelled through a 10 mesh screen, and the resulting droplets are collected on a sheet of paper. The droplets striking the paper leave various sized marks depending upon the size of droplets. The number of marks of various sizes are counted using a Zeiss Image Analyzer. The number of marks smaller than 0.5 mm, 0.68 mm, 0.86 mm and 1.05 mm relative to the total number of marks formed on the paper are presented for each sample in Table I. As previously mentioned, each sample contains a small amount of methylene blue dye and is prepared and designated as follows.

Sample No. 1 is 99.5 percent deionized water, 0.23 percent cetyltrimethylammonium salicylate and 0.27 percent sodium salicylate.

Sample No. 2 is 99.4 percent deionized water, 0.23 percent cetyltrimethylammonium salicylate, 0.27 percent sodium salicylate and 0.1 percent 2,4-dichlorophenoxyacetic acid (i.e., a water-soluble ingredient).

Sample No. 3 is 99.5 percent deionized water and 0.5 percent cetyltrimethylammonium-4-amino-3,5,6trichloropicolinate.

Sample No. 4 is 99.5 percent deionized water and 0.5 percent of a surfactant represented by the formula:

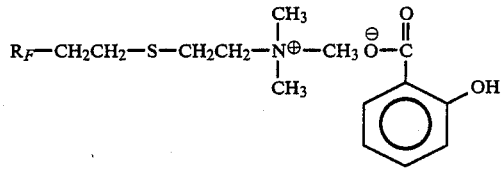

wherein the cationic portion is sold as Zonyl ® FSC by E. I. du Pont de Nemours & Co.

Sample No. 5 is 97.5 percent deionized water, 0.5 percent of the surfactant described in Sample No. 4 and 2 percent toluene.

Sample No. 6 is 97.5 percent deionized water, 0.5 percent of the surfactant described in Sample No. 4 and 2 percent mineral oil.

Sample No. C-1 is deionized water and is used for comparison purposes.

TABLE I

| Sample | Distribution C(N)/S(N) (1) | | | |
|---|---|---|---|---|
| | ≦0.5 mm | ≦0.68 mm | ≦0.86 mm | ≦1.05 mm |
| 1 | 0.37 | 0.51 | 0.67 | 0.73 |
| 2 | 0.074 | 0.11 | 0.19 | 0.26 |
| 3 | 0.33 | 0.47 | 0.57 | 0.60 |
| 4 | 0.096 | 0.19 | 0.29 | 0.35 |
| 5 | 0.024 | 0.22 | 0.32 | 0.37 |
| 6 | 0.23 | 0.50 | 0.65 | 0.68 |
| C-1* | 0.53 | 0.67 | 0.77 | 0.84 |

*Not an example of the invention.

(1) Distribution of mark sizes is presented as the ratio of the number of particles having a diameter less than or equal to the listed diameter (i.e., C(N)), to the total number of marks counted (i.e., S(N)).

The data in Table I indicates that the presence of the viscoelastic surfactant in a sample reduces the number of small-sized droplets relative to the sample containing only water. Of particular interest is the distribution of mark sizes less than or equal to 0.5 mm. The data also indicates that the perfluoroalkyl surfactant (i.e., as used in Sample Nos. 4, 5 and 6) maintains good viscoelastic behavior and, hence, mist reduction when in the presence of an aqueous liquid containing an immiscible additive (i.e., Sample Nos. 5 and 6).

What is claimed is:

1. An aqueous composition which comprises:

(a) surfactant ions each consisting of a fluoroaliphatic, hydrophobic moiety chemically bonded to a cationic, hydrophilic moiety;

(b) organic counterions that associate with the surfactant ions in the aqueous composition thereby forming a viscoelastic surfactant; and (c) water.

2. The composition of claim 1 wherein said fluoroaliphatic hydrophobic moiety is a perfluorocarbon moiety.

3. The composition of claim 1 wherein said fluoroaliphatic hydrophobic moiety is linear.

4. The composition of claim 1 wherein said counterions are salicylate ions.

5. The composition of claim 1 wherein said fluoroaliphatic hydrophobic moiety contains from about 3 to about 20 carbon atoms wherein all carbons are fully fluorinated.

6. The composition of claim 1 wherein said surfactant compound is selected from a member of the group consisting of $CF_3(CF_2)_rSO_2NH(CH_2)_sN^{\oplus}R''_3$; $R_FCH_2CH_2SCH_2CH_2N^{\oplus}R''_3$ and $CF_3(CF_2)_rCONH(CH_2)_sN^{\oplus}R''_3$; wherein R'' is lower alkyl containing between 1 and about 4 carbon atoms, r is about 2 to about 15 and s is about 2 to about 5.

7. The composition of claim 1 further comprising excess organic counterions.

8. The composition of claim 1 wherein the organic counterions are aromatic ions.

* * * * *

UNITED STATES PATENT AND TRADEMARK OFFICE

CERTIFICATE OF CORRECTION

PATENT NO. : 4,880,565

DATED : November 14, 1989

INVENTOR(S) : Gene D. Rose et al.

It is certified that error appears in the above-identified patent and that said Letters Patent is hereby corrected as shown below:

Column 3, line 35, "$R_1(Y^{63})X^{\oplus}$ or $R_1(Z^{\oplus})A^{\ominus}$ " should read --$R_1(Y^{\oplus})X^{\ominus}$ or $R_1(Z^{\ominus})A^{\oplus}$--; line 37, "$(Y^{\ominus})$ and $R_1(Z^{\oplus})$" should read --$(Y^{\oplus})$ and $R_1(Z^{\ominus})$--; line 41, "$(Y^{\ominus})$ or the anionic moiety $(Z^{\oplus})$" should read --$(Y^{\oplus})$ or the anionic moiety $(Z^{\ominus})$--; line 42; "$X^{\oplus}$ and $A^{\ominus}$" should read -- $X^{\ominus}$ and $A^{\oplus}$--.

Column 4, line 27, "$-OSO_3$," should read -- $-OSO_3^{\ominus}$,--; line 28, "$-SO_3$," should read-- $-SO_3^{\ominus}$,--; line 58, "below" should read --below.--.

Column 8, line 38, "agqregates" should read --aggregates--; line 49, "prepared sur-" should read --prepared by admixing the desired amounts of the viscoelastic sur- --.

Column 9, line 31,"5,6tri-" should read --5,6-tri- --.

Signed and Sealed this

Ninth Day of June, 1992

*Attest:*

DOUGLAS B. COMER

*Attesting Officer*

*Acting Commissioner of Patents and Trademarks*